US011142915B1

(12) United States Patent
Hohmann, Jr.

(10) Patent No.: US 11,142,915 B1
(45) Date of Patent: Oct. 12, 2021

(54) APPARATUS, SYSTEMS, AND METHODS FOR USE IN A CAVITY SPACE TO CONNECT TO A VENEER TIE THAT JOINS AN INNER WYTHE AND AN OUTER WYTHE OF THE CAVITY SPACE

(71) Applicant: Ronald Hohmann, Jr., Parkland, FL (US)

(72) Inventor: Ronald Hohmann, Jr., Parkland, FL (US)

( * ) Notice: Subject to any disclaimer, the term of this patent is extended or adjusted under 35 U.S.C. 154(b) by 0 days.

(21) Appl. No.: 16/927,107

(22) Filed: Jul. 13, 2020

(51) Int. Cl.
*E04F 13/08* (2006.01)
*E04B 1/41* (2006.01)
*E04B 1/98* (2006.01)

(52) U.S. Cl.
CPC ..... *E04F 13/0833* (2013.01); *E04B 1/4178* (2013.01); *E04B 1/4185* (2013.01); *E04B 1/98* (2013.01); *E04B 2001/4192* (2013.01)

(58) Field of Classification Search
CPC .. E04B 1/98; E04B 2001/4192; E04B 1/4185; E04B 1/4178; E04F 13/0833
USPC ..... 52/712–714, 379, 565, 513
See application file for complete search history.

(56) References Cited

U.S. PATENT DOCUMENTS 3,964,226 A * 6/1976 Hala ..... E04B 1/4185 52/562
4,660,342 A * 4/1987 Salisbury ..... E04B 2/8629 52/358
6,735,915 B1 * 5/2004 Johnson, III ..... E04B 1/4185 52/379
6,851,239 B1 * 2/2005 Hohmann ..... E04B 1/7616 52/379
7,017,318 B1 * 3/2006 Hohmann ..... E04B 1/4185 52/379
7,152,382 B2 * 12/2006 Johnson, III ..... E04B 1/4185 52/562
7,325,366 B1 * 2/2008 Hohmann, Jr. ..... E04B 1/4178 52/167.1
8,096,090 B1 * 1/2012 Hohmann, Jr. ..... E04H 9/02 52/513
8,122,663 B1 * 2/2012 Hohmann, Jr. ..... E04B 1/4185 52/379
8,613,175 B2 * 12/2013 Hohmann, Jr. ..... E04B 1/4178 52/379
8,733,049 B2 * 5/2014 Hohmann, Jr. ..... E04B 1/4178 52/379
8,739,485 B2 * 6/2014 Hohmann, Jr. ..... E04B 1/4178 52/379
8,800,241 B2 * 8/2014 Hohmann, Jr. ..... E04B 2/44 52/713

(Continued)

*Primary Examiner* — Brent W Herring
(74) *Attorney, Agent, or Firm* — Derek Fahey; The Plus IP Firm

(57) ABSTRACT

A wall anchor for use in a cavity space to connect to a veneer tie that joins an inner wythe and an outer wythe of the cavity space. In one embodiment, the wall anchor system for use in a cavity space to connect to a veneer tie that joins an inner wythe and an outer wythe of the cavity space is disclosed. The wall anchor includes a straight elongated shaft with a longitudinal axis. The wall anchor also includes a first receiving space defined by a first curved section and a second receiving space defined by a second curved section that are both in the cavity space upon installation. A first end of the wall anchor fusibly attaches to the single location at an outward facing side of the wire element.

20 Claims, 9 Drawing Sheets

(56) References Cited

U.S. PATENT DOCUMENTS

| | | | | |
|---|---|---|---|---|
| 8,833,003 | B1 * | 9/2014 | Hohmann, Jr. | E04B 1/98 52/167.1 |
| 8,898,980 | B2 * | 12/2014 | Hohmann, Jr. | E04B 1/4178 52/379 |
| 9,038,351 | B2 * | 5/2015 | Hohmann, Jr. | E04B 1/4185 52/714 |
| 9,273,460 | B2 * | 3/2016 | Hohmann, Jr. | E04B 2/30 |
| 9,273,461 | B1 * | 3/2016 | Hohmann, Jr. | E04B 1/4178 |
| 9,624,659 | B2 * | 4/2017 | Hohmann, Jr. | E04B 1/4178 |
| 9,732,514 | B2 * | 8/2017 | Hohmann, Jr. | E04B 2/54 |

* cited by examiner

APPARATUS, SYSTEMS, AND METHODS FOR USE IN A CAVITY SPACE TO CONNECT TO A VENEER TIE THAT JOINS AN INNER WYTHE AND AN OUTER WYTHE OF THE CAVITY SPACE

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of anchoring systems for building cavity spaces.

BACKGROUND

Much of today's multi-wythe walls have been made of a backup wall (i.e., concrete block) to support horizontal transverse loads exerted by the veneer wall (i.e., brick) or outer wythe. Anchoring systems for cavity spaces are used to secure the veneer wall or outer wythe of a building to overcome seismic and other forces, i.e., wind shear. A veneer wall is commonly defined as a wall having a facing of masonry units (brick veneer, stone veneer, etc.), or other weather-resisting, non-combustible materials, securely attached to the backup wall, but not so bonded as to exert common action under load intentionally. A veneer wall or outer wythe is supported horizontally by the backup wall via veneer ties embedded in joints on one end and attached to a backup wall anchor on the other end. Typically, the veneer ties the inner wythe and the outer wythe together and is flexible for in-plane horizontal and vertical movement and rigid perpendicular to the wall face. As a result, the veneer wall and the backup wall are isolated and do not behave identically under load. While the displacements perpendicular to the wall are typically the same, the vertical flexibility provided by the veneer tie allows for differences in response to vertical loading.

Joint reinforcement increases a wall's resistance to horizontal bending but is not widely recognized by the model building codes for structural purposes. Joint reinforcement types used in masonry principally are reinforcing bars and cold-drawn wire products. Joint reinforcement is governed by Standard Specification for Masonry Joint Reinforcement, ASTM A951, or Standard Specification for Stainless Steel Wire, ASTM A580/A580M Type 304 or Type 316, if the joint reinforcement is stainless steel according to the Specification for Masonry Structures. Joint reinforcement comes in several configurations ladder-type and truss-type joint reinforcement. Adjustable ties, tabs, third wires, and seismic clips may also be combined with joint reinforcement for multi-wythe walls.

Ladder-type joint reinforcement consists of longitudinal wires flush welded with perpendicular cross wires, creating a ladder's appearance. It is less rigid than truss-type joint reinforcement and is recommended for multi-wythe walls with cavity spaces. The ladder-type joint reinforcement permits the inner and outer wythe to move independently, yet still transfers out-of-plane loads from the exterior masonry to the interior masonry wall. In contrast, truss-type joint reinforcement consists of longitudinal wires connected with diagonal cross wires. This shape is stiffer in the plane of the wall than ladder-type joint reinforcement, and if used to connect the inner and outer wythe restricts differential movement between the inner and outer wythe. For this reason, it should be used only when differential movement is not a concern, as in single wythe concrete masonry walls. Because the diagonal cross wires may interfere with vertical reinforcing steel and grout, truss-type joint reinforcement should not be used in reinforced or grouted walls.

Today's multi-wythe walls that have an inner wythe and an outer wythe have numerous essential parts and, or materials, to support horizontal transverse loads exerted by the veneer wall (i.e., brick) or outer wythe. These parts and, or materials commonly include wire joint reinforcement, wall anchors (commonly called wall ties). The components that are used for connecting the inner and outer wythe are widely used. The cost of material, labor, and time to create and install the various parts and components required for multi-wythe walls can be significant. As a result of the number of the wall anchors parts and, or materials required, a need exists to improve over the prior art and, more particularly, for components that require less time, money, and energy to manufacture and install.

SUMMARY

A wall anchor system for use in a cavity space to connect to a veneer tie that joins an inner wythe and an outer wythe of the cavity space is disclosed. This Summary is provided to introduce a selection of disclosed concepts in a simplified form that are further described below in the Detailed Description, including the drawings provided. This Summary is not intended to identify key features or essential features of the claimed subject matter. Nor is this Summary intended to be used to limit the claimed subject matter's scope.

In one embodiment, the wall anchor system for use in a cavity space to connect to a veneer tie that joins an inner wythe and an outer wythe of the cavity space is disclosed. Attached to the wire joint reinforcement is the wall anchor configured to be disposed of in the inner wythe. The wall anchor system includes a wire joint reinforcement, which includes a wall anchor attached at a single location on the wire element that spans a portion of the inner wythe. The wall anchor includes a straight elongated shaft with a longitudinal axis. A first end of the elongated shaft fusibly attaches to the single location at an outward facing side of the wire element. The wall anchor includes a first receiving space and a second receiving space defined by either a first curved section or a second curved section positioned in the cavity space upon installation.

Additional aspects of the disclosed embodiment will be outlined in part in the detailed description, which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following Detailed Description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1B:
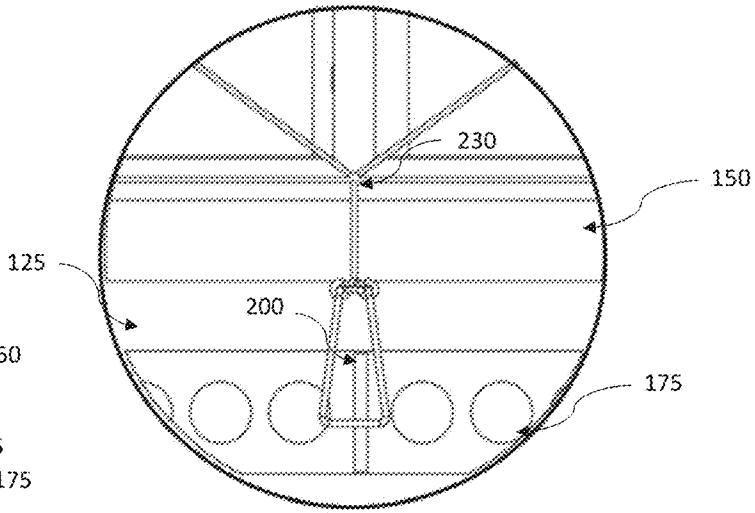
FIG. 1B is a zoomed in top view of the truss configured wire joint reinforcement illustrated in FIG. 1A, veneer ties, and wall anchor in a multi-wythe and/or a cavity-wall system.
Figure 1C:
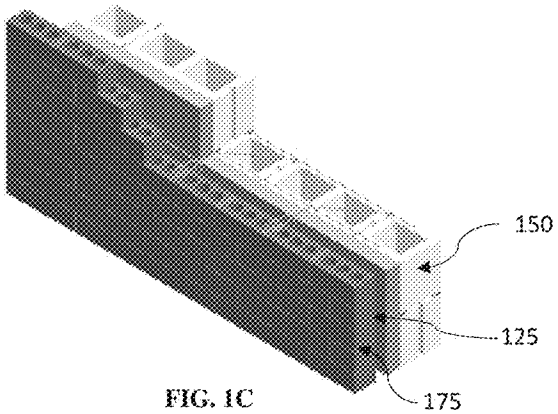
FIG. 1C is a perspective view of the wire joint reinforcement and wall anchor in a multi-wythe and/or a cavity-wall system.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings. The methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The present embodiments improve upon the prior art by providing an enhanced wire joint reinforcement and wall anchor with integral components, thereby decreasing the number of parts required for a wall anchor. This disclosure would eliminate the numerous wall anchor construct utilizable with various wire formative veneer ties. As a result, the manufacturing costs and storage costs would be lowered, improving both logistics and efficiency. The present embodiments only require one connection point to the joint wire reinforcement at single location which results in several efficiencies including decreasing the amount of time, money and energy required for construction. Additionally, the joint wire reinforcement approves over the prior art by only having a single straight elongated shaft connecting to the joint wire reinforcement within a single plane and using a single wire, which is less costly to manufacture. This also results in several efficiencies including decreasing the amount of time, money and energy required for construction.

Referring now to FIGS. 1A-2C, which illustrates one embodiment of the wall anchor system 100 (referred collectively as "system") for a multi-wythe and/or a cavity-wall system. A multi-wythe and/or a cavity-wall system allows for the inner wythe to avoid exposure to the outdoor elements, making for a more durable structural wall, and increases insulation capabilities. In the preferred embodiment, using multiple wythes allows for better weatherproofing, since water that enters the outer wythe is allowed to escape through the cavity space 125.

The system involves an inner wythe 150, a continuous vertical section of masonry, usually one unit thick. The inner wythe generally serves as a structural component of a building. The inner wythe may be composed of brick, stone, manufactured stone, clay, wood, and concrete. However, other types of wythes may be used and are within the spirit and scope of the present invention. The system involves an outer wythe 175, a continuous vertical section of masonry, usually one unit thick. The outer wythe generally serves as a non-structural external layer of masonry. However, the outer wythe may also be designed to be an external structural layer of masonry. Typically the outer wythe is composed of brick, stone, or manufactured stone. Generally, an outer wythe can be completed in a shorter time with less labor than the more solid inner wythe, thus saving in cost. The inner and outer wythe can either use all the same or different types of masonry.

The area in between the inner wythe and outer wythe, known as the cavity space 125, is an airspace that is used to provide a structure with additional insulating. In some embodiments, the cavity space may include rigid foam to increase the wall's thermal performance A first receiving space 280 (further explained below) is positioned in the anchor cavity space upon installation (see FIGS. 1A-2B) and is defined by a first curved section 300 that at least partially surrounds the first receiving space, and a second receiving space 280 (further explained below) is positioned in the anchor cavity space upon installation (see FIGS. 1A-2B) and is defined by a second curved section 325 that at least partially surrounds the first receiving space. In certain embodiments, a short connecting section 350 connects the first curved section with the second curved section.

The system is configured to connect to a veneer tie 200 that joins an inner wythe 150 (discussed below) and an outer wythe (discussed below) of the cavity space 125. The veneer tie 200 is a wire formative that is fixedly disposed of in an x-z plane of the mortared bed joint. The veneer tie is constructed to adjustably position with the longitudinal axis substantially horizontal and to connect with the wall anchor 250. The veneer tie has an aperture receiving end for disposition on said elongated body and an insertion end configured for embedment in the mortared bed joint. The veneer tie is vertically adjustable to a substantially horizontal position and, upon installation, maintains a continuous positive connection with the wall anchor 250. For additional seismic and high-wind protection, a wire joint reinforcement (discussed below) is embedded in the mortared bed joint.

Figure 1A:
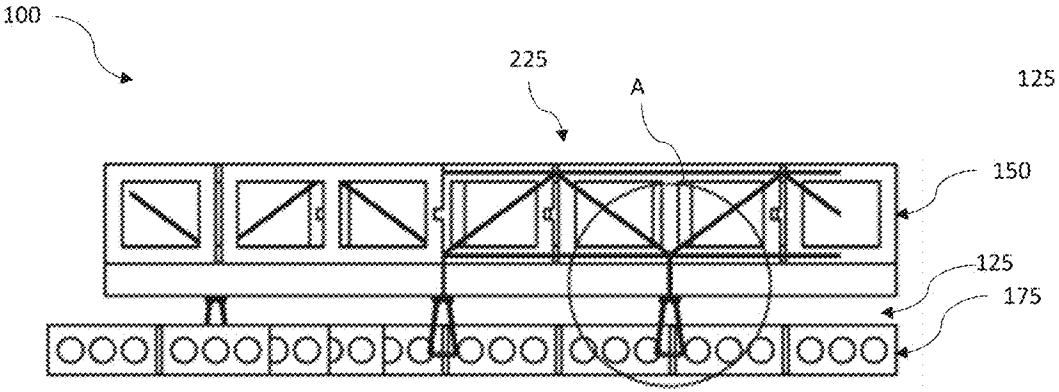
FIG. 1A is a top view of a schematic of a truss configured wire joint reinforcement and wall anchor in a multi-wythe and/or a cavity-wall system.
Figure 2B:
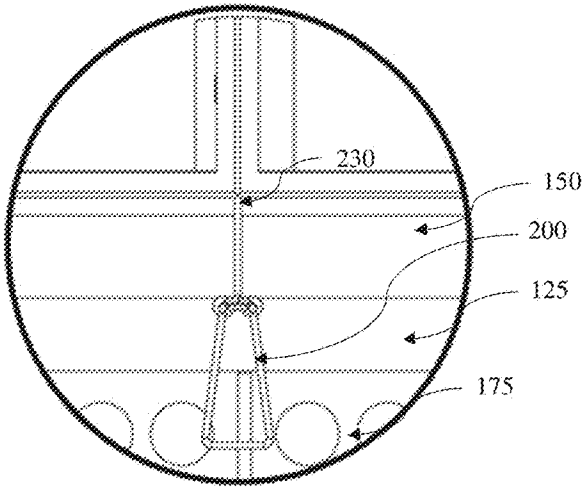
FIG. 2B is a top zoomed in view of a portion of the truss configured wire joint reinforcement illustrated in FIG. 2A, veneer ties, and wall anchor in a multi-wythe and/or a cavity-wall system.
Figure 2C:
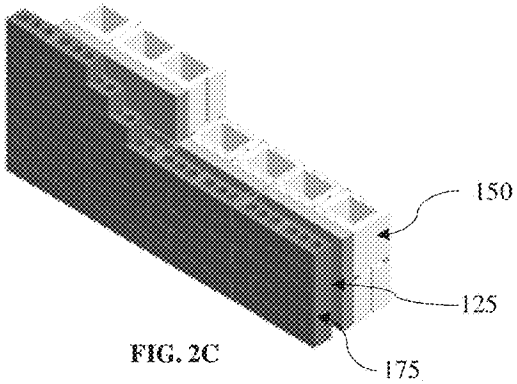
FIG. 2C is a perspective view of the wire joint reinforcement and wall anchor in a multi-wythe and/or a cavity-wall system.
Figure 2A:
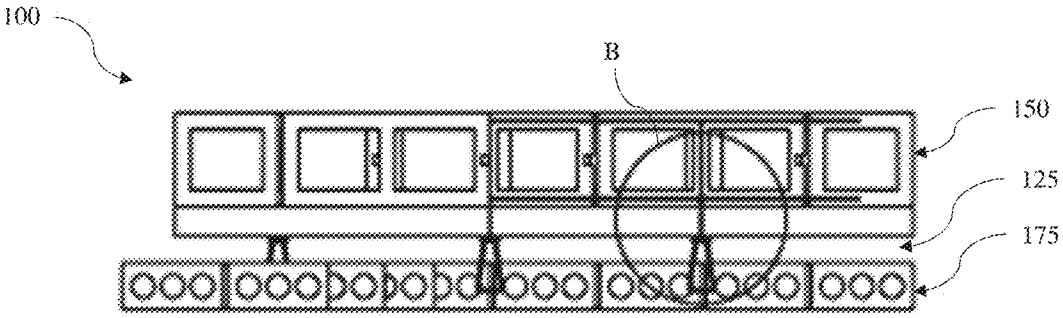
FIG. 2A is a top view of a schematic of a ladder configured wire joint reinforcement and wall anchor in a multi-wythe and/or a cavity-wall system.

In the present embodiment, a wire joint reinforcement 225 comprising at least a wire element 235 configured to be disposed of in the inner wythe 150. The wire element spans at least a portion of the inner wythe 150. As illustrated in FIGS. 1A and 2A, the wire joint reinforcement 225 may be arranged in at least one of either a truss configuration (FIG. 1A) or a ladder configuration (FIG. 2A) and may be prefabricated, galvanized steel wire a zinc coating that protects the steel from water and oxygen, however stainless or fusion-bonded, epoxy-coated steel wires are available for walls subject to corrosive environments, where corrosion is not a problem, the use of uncoated wire, wire with a basic finish is possible. However, other types of materials may be used and are within the spirit and scope of the present invention.

However, other wire joint reinforcement 225 alternatives may be used and/or adapted equivalent adapted for embedment into the horizontal mortar joints of masonry walls. Generally, wire joint reinforcement 225 may be composed of plain or deformed cold-drawn steel wire that should be at least nine gauges but not more than one-half the thickness of the mortared bed joint. Most manufacturers classify joint reinforcement as standard, medium, and heavy according to the longitudinal wire's diameter. In a specific embodiment, the truss configured wire joint reinforcement restrain differential movement. In another specific embodiment, the ladder configured wire joint reinforcement is the cross wires of ladder-type reinforcement deform allowing the differential movement that occurs between the two wythes of a cavity wall.

As mentioned above, in the certain of the present embodiments, the wall anchor 250 comprises an elongated shaft 255, a first curved section 300 and a second curved section 325. Optionally a short connecting section 350 my connect the first and second curved sections. It is to be understood that wall anchor 250 may comprise multiple of any component disclosed herewith as long as wall anchor and wire joint reinforcement may utilize said additional components for the intended functionality. The wall anchor may include materials similar or the same as the materials used to make the wire reinforcement. However, other types of materials may be used that are within the spirit and scope of the present invention. For example, other types of materials may be used that that comprise at least one of an ablative material, a boron fiber material, a carbon fiber material, a ceramic matrix composite material, a composite material, an epoxy matrix composite, a fatigue composite material, a fiber composite, a fiber-matrix interface, a filament material, a filament wound structures composite material, a filament-matrix material, a flammability composite materials, a glass fiber reinforced plastic material, a honeycomb material, an insulation composite material, a laminate material, a metal filament system, a metal matrix composite (MMC), a nanocomposite, an off-gassing/out-gassing composite material, a polymer matrix composite, a reinforcing fibers composite material, a stacking sequence composite material, a surface property composite material, whisker composite, a woven composite material and any combination of the foregoing material.

Now referring to FIGS. 3-9, the wall anchor comprises a straight elongated shaft 255 having a longitudinal axis 260, a first end 265, and a second end 270. The first end 265 is attached fusibly to the single location 230 at an outward facing side of the wire element 235. The attachment of the wall anchor to the wire reinforcement at single location 230 is important because it results in serval benefits as mentioned above. FIGS. 1B and 2B are zoomed in portions (within circles A and C) of top views of the single connection point where the elongated shaft is connected to the wire reinforcement. All the embodiments in this application have a single connection point to the wire reinforcement. It is also important to note that the anchor may be made from a single wire unit, which decreases in production costs as well as other costs and provides an improvement over the prior art.

Figure 5:
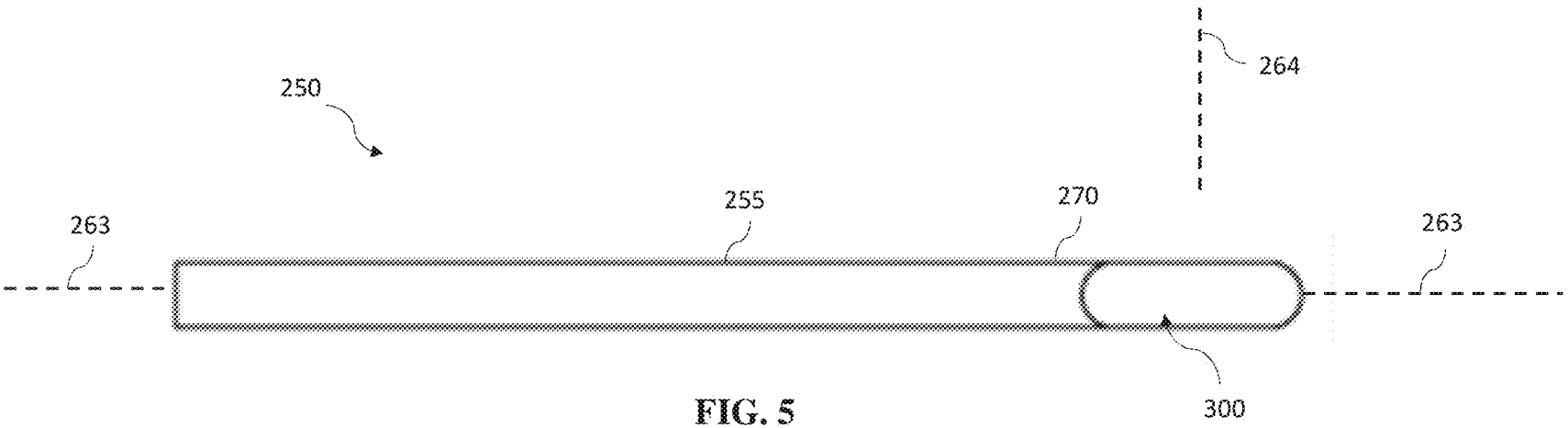
FIG. 5 is a side view of a wire joint reinforcement and wall anchor body with a curved section planer to the straight elongated shaft, according to an exemplary embodiment.

The straight elongated shaft 255, first curved section 300 and second curved section 325 extend along a single plane 263 (see FIG. 5). The single plane is important because it allows the arrangement of anchor within cavity 125 in a particular arrangement to be connected with the veneer tie and decreases installation, production and labor costs. The arrangement that this allows the veneer tie to be in can be critical in certain situations.

The first curved section 300 is attached or positioned proximate to the second end of the elongated shaft and on the first side 291 of the longitudinal axis. The first curved section may define a variety of different shapes (as illustrated in FIGS. 1A-9B) and is configured to form the first receiving space that receives a portion of the veneer tie. The first curved section is positioned proximate to second end 270 of the straight elongated shaft 255. The first receiving space is positioned to the first side 291 of the first longitudinal axis 260 of the shaft. It is understood that the first curved section may define a variety of different shapes as illustrated in the figures. It is also understood as illustrated in the figures that the first receiving space may define a plurality of different shapes as illustrated in the figures. However, it is understood that other embodiments may be used within the spirit and scope of the present invention.

Figure 4C:
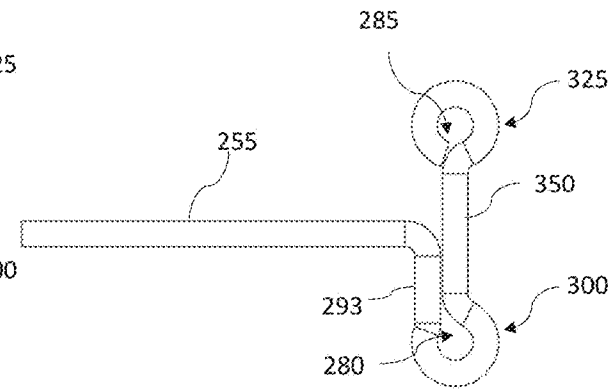
FIG. 4C is a top view of a wire joint reinforcement and wall anchor body with a first and second curved section out-of-line with a connecting section having a fourth length, according to a fourth exemplary embodiment.
Figure 4B:
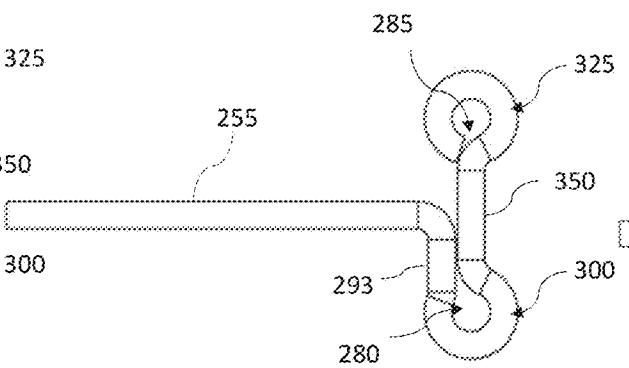
FIG. 4B is a top view of a wire joint reinforcement and wall anchor body with a first and second curved section out-of-line with a connecting section having a third length, according to a third exemplary embodiment.
Figure 4A:
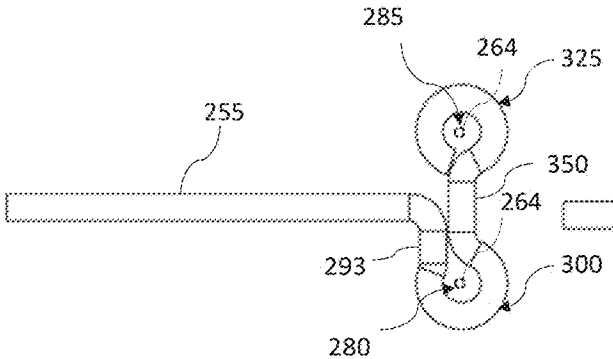
FIG. 4A is a top view of a wire joint reinforcement and wall anchor body with a first and second curved section out-of-line with a connecting section having a second length, according to a second exemplary embodiment.

The second curved section 325 is attached or portioned proximate to the second end of the elongated straight shaft and on a second side 292 of the longitudinal axis. A second receiving space 285 is positioned in the anchor cavity space upon installation (see FIGS. 1A-2B) and is defined by a second curved section 325 that at least partially surrounds the second receiving space. The second curved section is positioned proximate to second end 270 of the straight elongated shaft 255. The second receiving space is positioned to the first side 291 of the first longitudinal axis 260 of the shaft. It is understood that the second curved section It is also understood as illustrated in the figures that the second receiving space may define a plurality of different shapes as illustrated in the figures. However, it is understood that other embodiments may be used in the within the spirit and scope of the present invention. may define a variety of different shapes as illustrated in the figures. The first receiving space and second receiving space each have a longitudinal axis (line 264 best illustrated in FIG. 5) that is perpendicular with the longitudinal axis of the shaft. The axis 264 of each receiving space is perpendicular with each other (as illustrated in FIG. 4A).

In certain embodiments, a short connecting section 350 connects the first curved section 300 with the second curved section 325. The short connecting section 350 extends across an area outward from the second end 270 of the elongated shaft 255. The short connecting section may exhibit alternative embodiments which may include, but is not limited to the short connecting section being 1.0 in long, 1.250 in long, 1.50 in long, and, or 2.0 in long as illustrated in FIGS. 4A-4C and 3. However lengths may be used and are within the spirit and scope of the present invention. Additional short connecting section embodiments may involve the short connecting section as curved and, or non-curved as illustrated in FIGS. 1A-9.

The short connecting section generally connects the first curved section with the second curved section. However, the current disclosure is not limited to two curved sections. The first curved section has a first end 267 fusibly attached to the second end 270 of the elongated shaft 255. The second curved section has a first end 268 fusibly attached to the second end 270 of the elongated shaft 255. The curved sections are fusibly attached to the elongated shaft 255 by a commonly used but not limiting technique known as butt welding, which can be performed either automatically and, or done with hand by steel pieces. However, it is understood that other means for attaching the elongated shaft may be used and are within the spirit and scope of the present invention. In certain embodiments the connecting section may have a longer length than each of the first curved portion and second current portion (as illustrated in FIG. 4C). In other embodiments, the connecting section may have a shorter length than each of the first curved section and second current portion (as illustrated in FIG. 4A). In certain embodiments the entire anchor is formed from a single wire that is formed or bent by processes that are known to those skilled in the art. It is understood that other means for forming the wall anchor may be used and are within the spirit and scope of the present invention. In other embodiments, the shaft, curved section and connecting section may be formed from multiple pieces welded tighter.

Figure 7B:
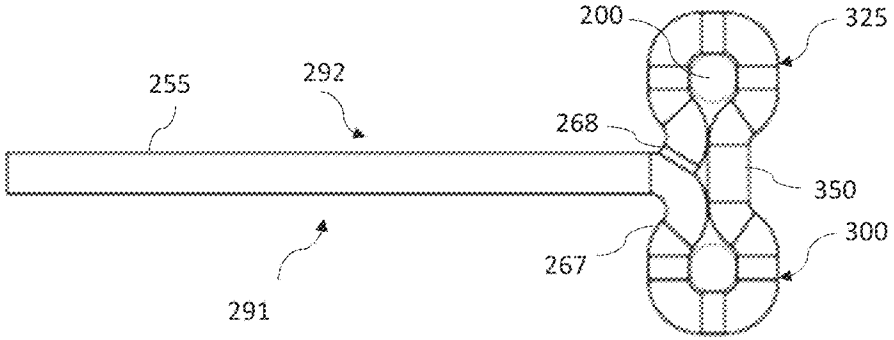
FIG. 7B is a top view of a wire joint reinforcement and wall anchor body with a first and second curved section having a fourth shape and a straight connecting section, according to a non-angled square exemplary embodiment.
Figure 7A:
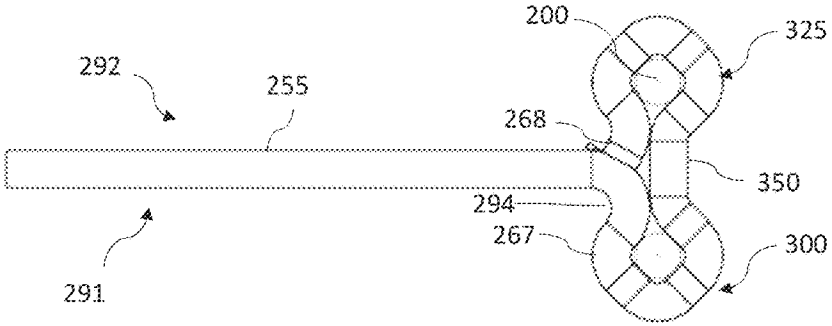
FIG. 7A is a top view of a wire joint reinforcement and wall anchor body with a first and second curved section having a third shape and a connecting section, according to an angled square exemplary embodiment.
Figure 8B:
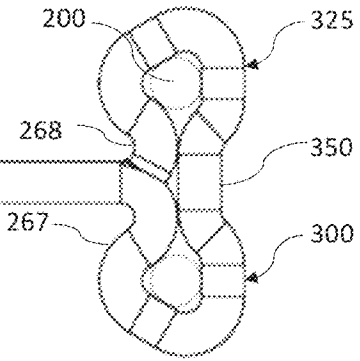
FIG. 8B is a top view of a wire joint reinforcement and wall anchor body with a first and second curved section having a sixth shape with a connecting section, according to an exemplary triangle embodiment.
Figure 8B:
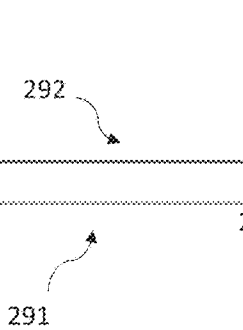
Figure 8A:
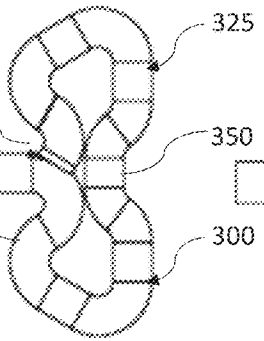
FIG. 8A is a top view of a wire joint reinforcement and wall anchor body with a first and second curved section having a fifth shape and a connecting section, according to an exemplary triangle embodiment.
Figure 8A:
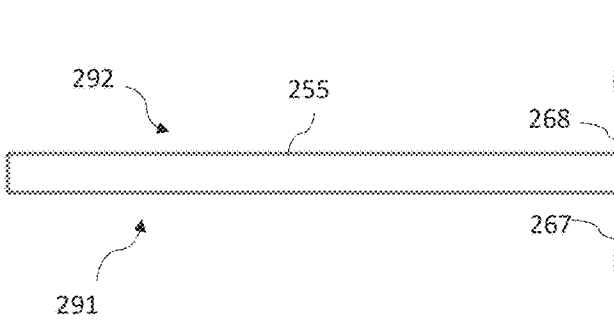
Figure 9B:
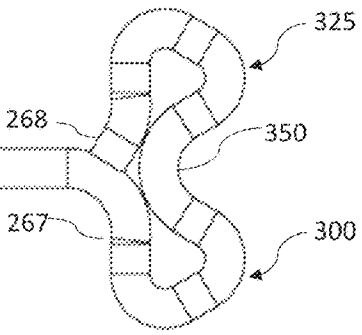
FIG. 9B is a top view of a wire joint reinforcement and wall anchor body with a first and second curved section having an eight shape and a curved connecting section, according to an exemplary triangle embodiment.
Figure 9B:
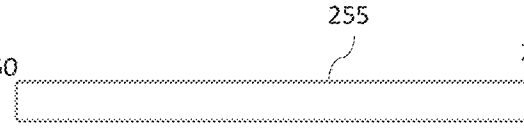
Figure 9A:
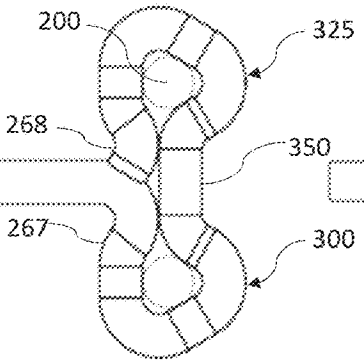
FIG. 9A is a top view of a wire joint reinforcement and wall anchor body with a first and second curved section having a seventh shape and a straight connecting section, according to an exemplary triangle embodiment.
Figure 9A:
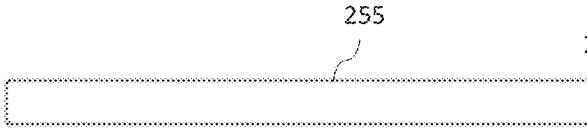

In certain embodiments, each of curved sections may include additional straight sections 293 (as illustrated in FIGS. 3, 4A-C), between the second end of the elongated shaft and the first end of the curved sections. In other embodiments, each of curved sections may include additional curved sections 294 (as illustrated in FIG. 7A), between the second end of the elongated shaft and the first end of the curved sections. In other embodiments the curved sections may be connected directly to each other with no straight connection section.

Figure 3:
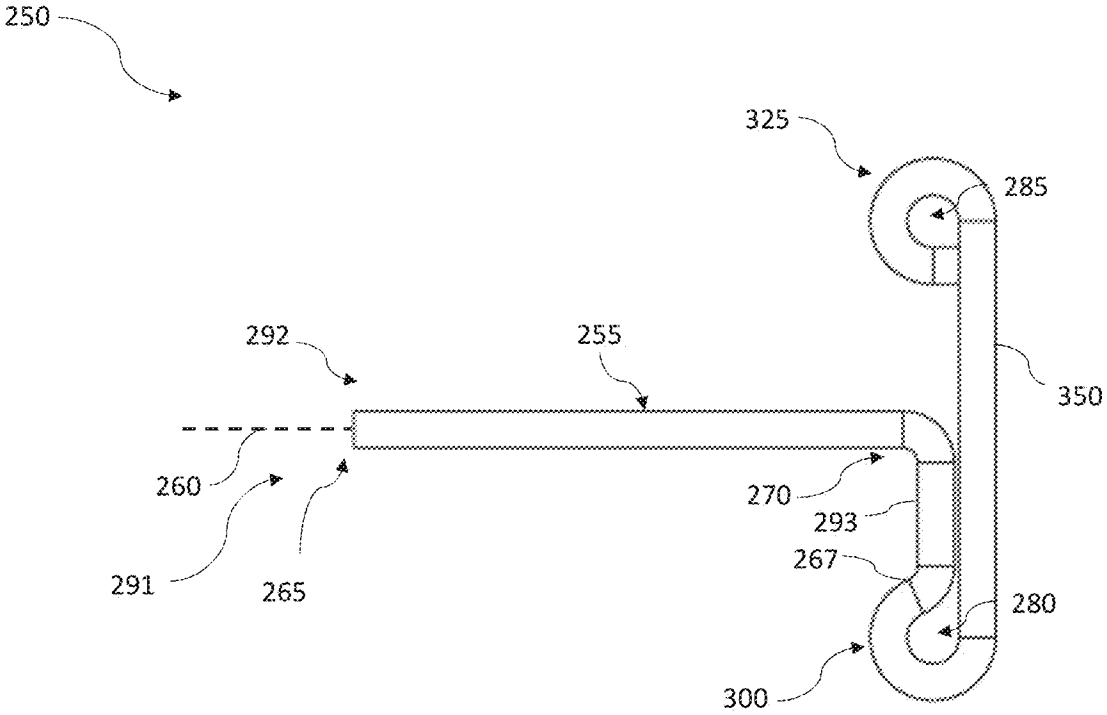
FIG. 3 is a top view of a wire joint reinforcement and wall anchor body with a first and second curved section in-line with a connecting section having a first length, according to a first exemplary embodiment.
Figure 6B:
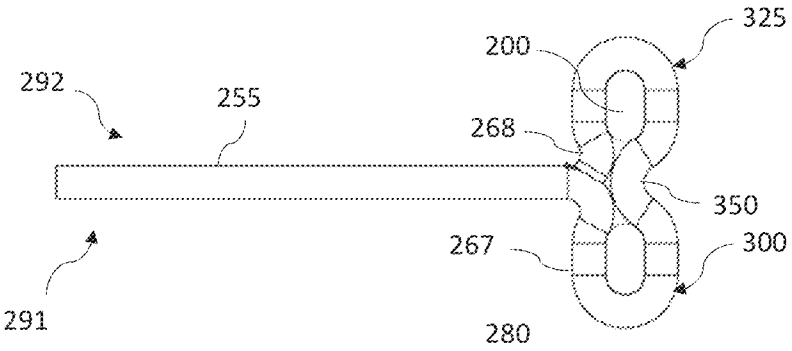
FIG. 6B is a top view of a wire joint reinforcement and wall anchor body with a first and second curved section having a second shape and a connecting section, according to an exemplary embodiment.
Figure 6A:
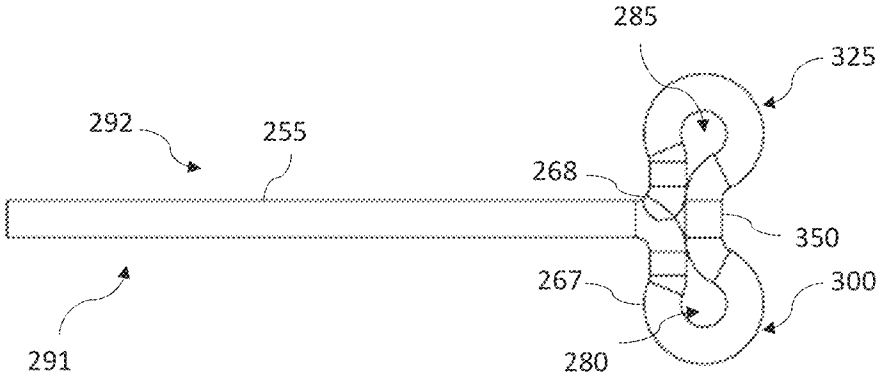
FIG. 6A is a top view of a wire joint reinforcement and wall anchor body with a first and second curved section having a first shape and having a connecting section, according to an exemplary embodiment.

In an alternative embodiment, the short connecting section 350 may define a third curved section having a first end and a second end and where each end of the third curved section is connected to each of the second ends of the first curved section 300 and the second curved section 325. The curved sections may include but are not limited to an angled square shape, a non-angled square shape, and a triangle shape. However, it is understood that other shapes and angles may be used and are within the spirt and scope of the present invention. In certain embodiments, the ends of the second curved element may attach to the connecting portion 350 (as illustrated in FIG. 3). The ends of the curved sections may be fusibly connected on not fusibly connected. In other embodiments, the first end of the section curved section may not be fusibly connected with the second end of the shaft (for example as illustrated in FIGS. 6A and 6B. In certain embodiments, portions of the curved section may be attached or fusbily connected with other portions of the anchor to increase the strength of the wire (as illustrated in FIG. 6A-9B).

Although the subject matter has been described in language specific to structural features and/or methodological acts, it is to be understood that the subject matter defined in the appended claims is not necessarily limited to the specific features or acts described above. Instead, the specific features and acts described above are disclosed as example forms of implementing the claims.

I claim:

1. An anchor system for use in a cavity space to connect to a veneer tie that joins an inner wythe and an outer wythe of the cavity space, the wall anchor system comprising:

a wire joint reinforcement configured to be disposed in the inner wythe, the wire joint reinforcement comprising at least a wire element that spans at least a portion of the inner wythe;

a wall anchor attached to the wire joint reinforcement at a single location on the wire element outward relative to the cavity space, said wall anchor comprising a single and continuous wire element, wherein the continuous wire element comprises:

at most one elongated shaft having a longitudinal axis, a first end and a second end, where the first end of the elongated shaft fusibly attaches to the single location on the wire element;

a first receiving space disposed in the cavity space upon installation and defined by a first curved section at the second end of said at most one elongated shaft, where the first receiving space is positioned on a first side of the longitudinal axis of said at most one elongated shaft;

a second receiving space disposed in the cavity space upon installation defined by a second curved section at the second end of said at most one elongated shaft, where the second receiving space is positioned on a second side of the longitudinal axis of said at most one elongated shaft; and where the first curved section and second curved section forms a continuous path with the at most one elongated shaft.

2. The system of claim 1, where the first receiving space has a first receiving space longitudinal axis that is perpendicular with the longitudinal axis of said at most one elongated shaft, where the second receiving space has a second receiving space longitudinal axis that is perpendicular with the longitudinal axis of said at most one elongated shaft, and where the first receiving space longitudinal axis and second receiving space longitudinal axis are parallel with each other.

3. The system of claim 1, where that said at most one elongated shaft, the first curved section and second curved section extend along a single plane.

4. The system of claim 1, where the first curved section is in connection with the second curved section.

5. The system of claim 1, where the wall anchor further comprises a short connecting section that connects the first curved section with the second curved section and where the short connecting section extends across an area outward from the second end of the at most one elongated shaft.

6. The system of claim 5, where a first end of the first curved section is fusibly attached to the second end of said shaft.

7. The system of claim 6, where a first end of the second curved section is fusibly attached to the second end of the at most one elongated shaft.

8. The system of claim 1, where the wire joint reinforcement configured to be disposed in the inner wythe and is arranged in at least one of a ladder and truss configuration.

9. A wall anchor system for use in a cavity space to connect to a veneer tie that joins an inner wythe and an outer wythe of the cavity space, the wall anchor system comprising:

a wire joint reinforcement configured to be disposed in the inner wythe, the wire joint reinforcement comprising at least a wire element that spans at least a portion of the inner wythe;

a wall anchor attached to the wire joint reinforcement at a single location on the wire element outward relative to the cavity space, said wall anchor comprising a single and continuous wire element, wherein the continuous wire element comprises:

at most one elongated elongated shaft having a longitudinal axis, a first end and a second end, where the first end of said elongated shaft fusibly attaches to the single location on the wire element;

a first receiving space disposed in the cavity space upon installation and defined by a first curved section at the second end of said at most one elongated shaft, where the first receiving space is positioned on a first side of the longitudinal axis of said at most one elongated shaft; and, a second receiving space disposed in the cavity space upon installation defined by a second curved section at the second end of the said at most one elongated shaft, where the second receiving space is positioned on a second side of the longitudinal axis of said at most one elongated shaft; and, where the first curved section and second curved section extend along a single plane and where the first curved section is in connection with the second curved section; and where the first curved section and second curved section forms a continuous path with the at most one elongated shaft.

10. The system of claim 9, where the first receiving space has a first receiving space longitudinal axis that is perpendicular with the longitudinal axis of said at most one elongated shaft, where the second receiving space has a second receiving space longitudinal axis that is perpendicular with the longitudinal axis of said at most one elongated shaft, and where the first receiving space longitudinal axis and second receiving space longitudinal axis are parallel with each other.

11. The system of claim 10, where a short connecting section connects the first curved section with the second curved section and where the short connecting section extends across an area outward from the second end of the at most one elongated shaft.

12. The system of claim 11, where a first end of the first curved section is fusibly attached to the second end of said at most one elongated shaft.

13. The system of claim 12, where a first end of the second curved section is fusibly attached to the second end at most one elongated shaft.

14. The system of claim 13, where the wire joint reinforcement configured to be disposed in the inner wythe and is arranged in at least one of a ladder and truss configuration.

15. The system of claim 14, where the connecting section defines a third curved section having a first end and a second end and where each end of the third curved section is connected to each of the second ends of the first curved section and second curved section.

16. A wall anchor for use in a cavity space to connect to a veneer tie that joins an inner wythe and an outer wythe of the cavity space, the wall anchor comprising a single and continuous wire element, wherein the continuous wire element comprises:

at most one elongated shaft having a longitudinal axis, a first end and a second end, where the first end of said elongated shaft is configured to fusibly attach to a wire joint reinforcement at a single location;

a first receiving space disposed in the cavity space upon installation and defined by a first curved section at the second end of said at most one elongated shaft, where the first receiving space is positioned on a first side of the longitudinal axis of said at most one elongated shaft; and, a second receiving space disposed in the cavity space upon installation defined by a second curved section at the second end of said at most one elongated shaft, where the second receiving space is positioned on a second side of the longitudinal axis of said at most one elongated shaft; and, wherein the first curved section and second curved section forms a continuous path with the at most one elongated shaft.

17. The wall anchor of claim 16 where that said at most one elongated shaft, the first curved section and second curved section extend along a single plane and where the first curved section is in connection with the second curved section.

18. The wall anchor of claim 17, where a first end of the second curved section is fusibly attached to the second end of said at most one elongated shaft.

19. The wall anchor of claim 16, where the wall anchor further comprises a short connecting section that connects the first curved section with the second curved section and where the short connecting section extends across an area outward from the second end of said at most one elongated shaft.

20. The wall anchor of claim 19, where a first end of the first curved section is fusibly attached to the second end of said at most one elongated shaft.

* * * * *